US005992991A

United States Patent [19]

Kanemoto et al.

[11] Patent Number: 5,992,991

[45] **Date of Patent: *Nov. 30, 1999**

[54] INK JET RECORDING DEVICE WITH AC AND DC HEATERS SELECTIVELY USED FOR HOT MELT INK

[75] Inventors: Seiichi Kanemoto; Shogo Suzuki, both of Nagoya, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/755,362

[22] Filed: Nov. 25, 1996

[30] Foreign Application Priority Data

Nov. 24, 1995 [JP] Japan ..... 7-329576
Dec. 15, 1995 [JP] Japan ..... 7-347994

[51] Int. Cl.[6] ..... B41J 2/175; B41J 29/38; B41J 2/165

[52] U.S. Cl. ..... 347/88; 347/17; 347/23

[58] Field of Search ..... 347/88, 99, 17, 347/23

[56] References Cited

U.S. PATENT DOCUMENTS 4,814,786 3/1989 Hine et al. ..... 347/88
5,159,355 10/1992 Horio et al. ..... 347/17
5,392,065 2/1995 Suzuki ..... 347/17

FOREIGN PATENT DOCUMENTS 0 178 886 4/1986 European Pat. Off. .
0 683 051 11/1995 European Pat. Off. .

*Primary Examiner*—Benjamin R. Fuller
*Assistant Examiner*—Thien Tran
*Attorney, Agent, or Firm*—Oliff & Berridge, PLC

[57] ABSTRACT

To start up an ink jet recording device in a short period of time, an AC heater section is energized to melt hot melt ink so that a solid state ink becomes a molten state ink, and a DC heater section is used to maintain hot melt ink in a molten state. The AC heater section is connected a socket that is provided in a recording head movable in a main scanning direction. A plug connected to an AC power source is provided in the lower cover. The socket engages the plug when the recording head is in a home position where the recording head is disposed when the device is powered. The DC heater section is connected to a DC power source at all times when the device is in use. High thermal output generated by the AC heater section melts the ink and heats up to the temperature suitable for printing in a short period of time. The DC heater section maintains the ink at the temperature suitable for printing.

18 Claims, 14 Drawing Sheets

INK JET RECORDING DEVICE WITH AC AND DC HEATERS SELECTIVELY USED FOR HOT MELT INK

BACKGROUND OF THE INVENTION

The present invention relates to an ink jet recording device for printing by ejecting hot melt ink on recording paper.

Communications devices, such as facsimile machines, and information processing devices, such as personal computers, usually have a recording device capable of recording data on recording paper in order to record text and image data as visual information. A variety of recording devices, such as impact type, thermal sensitive type, and ink jet type recording devices, are used. Recently, ink jet recording devices using hot melt ink have drawn more attention because of capability of printing clear images on various quality recording paper quietly.

Conventionally, a recording head of the above-described ink jet recording device is provided with a DC heater for heating hot melt ink which is solid at room temperature. The hot melt ink becomes a molten state when heated by the DC heater. The molten-state ink is ejected from nozzles in the recording head onto the recording paper while moving the head in a main scanning direction. The ink cools down rapidly and solidifies after ejected on the recording paper, so that the ink does not run into the paper and thus is not blurred unlike liquid inks. A high quality image can therefore be obtained with the hot melt ink.

In the conventional recording head described above, the thermal output of the DC heater is set to maintain the ink in a molten state but not set to melt the solid-state ink. For example, a DC 40V is applied to the DC heater. Such a low-voltage DC power source cannot generate large thermal output. Therefore, it requires a long period of time (for example, 20 minutes) for the DC heater to melt the solid-state ink after the recording device is powered. A DC heater generating a high thermal output can shorten the waiting time t the time of startup. However, such a DC heater requires an enhanced DC power source capable of supplying a high level DC voltage. The use of the enhanced DC power source increases the cost of component, resulting in an increase of the entire cost of a recording device.

The use of an AC heater requiring no power source does not invite an increase of cost. However, to do so, a reinforced wiring of a dual insulation structure needs to be used in a power supply path in order to satisfy various safety standards, e.g., UL standard. When the AC heater is moved in a main scanning direction together with the recording head, scanning is likely destabilized because of the reinforced wiring. Also, because the wiring is directly connected to a commercial power supply, malfunction due to external noise more likely occurs during scanning. More seriously, when a 100V AC power source is used, the thermal output generated by the AC heater is too high to achieve fine control of the ink temperature.

SUMMARY OF THE INVENTION

In view of the foregoing, it is an object of the present invention to provide an ink jet recording device capable of setting up the recording device in a short period of time.

Another object of the present invention is to provide an ink jet recording device capable of finely controlling temperature of melted ink.

To achieve the above and other objects, there is provided an ink jet recording device including a recording head for ejecting ink droplets onto a recording medium to record images thereon, heating means for heating the ink, AC power supplying means, and DC power supplying means. The ink used in the recording device is a so-called hot melt ink which is in solid state at a room temperature and is brought to a molten state when heated up to a predetermined temperature. The heating means including an AC heater energized by an AC power and a DC heater energized by a DC power wherein the AC heater generates a first thermal output and the DC heater generates a second thermal output smaller than the first thermal output. The AC power supplying means supplies the AC power to the AC heater when the AC power supplying means is enabled. The DC power supplying means supplies the DC power to the DC heater when the DC power supplying means is enabled. At least the AC power supplying means is enabled when the ink jet recording device is powered. The AC heater is set to generate an adequate amount of thermal energy for melting the hot melt ink and the DC heater is set to generate a minimum amount of thermal energy required for maintaining the molten state of the hot melt ink. Therefore, when the recording head is in the home position, the AC heater with sufficient thermal output to melt the hot melt ink heats the hot melt ink rapidly to the molten state. Consequently, device startup can be completed in a short period of time.

Both the AC power supplying means and the DC power supplying means may be enabled when melting the ink, i.e., when changing the phase of the ink from the solid state to the molten state. After the ink is brought to the molten state, only the DC power supplying means is enabled to maintain the molten state of the ink.

Alternatively, only the AC power supplying means may be enabled when melting the ink. After the ink is melted, the AC power supplying means is disabled and instead the DC power supplying means is enabled.

In the ink jet recording device of the type wherein the recording head is disposed in a home position at a time of powering the ink jet recording device and moves in a main scanning direction when ejecting the ink droplets onto the recording medium, both the AC power supplying means and the DC power supplying means may be enabled when the recording head is in the home position. When the recording head is in a position other than the home position, that is, when the recording head is in a printable position, only the DC power supplying means is enabled.

In one example, as shown in FIG. 9, the AC power supplying means includes a socket 71 and a plug 72. The socket 71 is provided in the recording head 12 so as to be movable with the recording head 12and connected to the AC heater 62. The plug 72 is provided in the frame 1, 2 and connected to an AC power source 73. The socket 71 and the plug 72 are engaged with each other to connect the AC power source 73 to the AC heater 62 when the recording head 12 is in the home position. The socket 71 is disengaged from the plug 72 so that the AC heater 62 is disconnected from the AC power source 73 when the recording head is in the position other than the home position. In this structure, the AC power source 73 supplies the AC power to the AC heater 62 only when the recording head 12 is in the home position where the recording head 12 is disposed at the time of startup. Therefore, the hot melt ink can be quickly melted with the AC heater 62.

Preferably, the heating means includes a plate-shaped base member 61 made from an insulating material, first and second electrode members 65, and first and second lead wires 66. The AC heater 62 that is also a plate-shaped configuration is formed on one surface of the base member 61 and the DC heater 63 that is also a plate-shaped configuration is formed on the other surface of the base member 61. The first electrode member 65 is formed on the first surface and connected to the AC heater 62. Likewise, the second electrode member 65 is formed on the second surface and connected to the DC heater 63. The first lead wire 66 is connected at one end to the first electrode member 65 and at another end to the plug 72. The second lead wire 66 is connected at one end to the second electrode member 65 and at another end to a DC power source 74. The plug 72 is connected to the AC power source 73 by a reinforced wiring 75 of a dual insulation structure. In this structure, because the AC heater 62 and the AC power source 73 are disconnected when the recording head 12 moves back and forth in the main scanning direction, the movement of the recording head 12 is not bothered by the reinforced wiring which is required to use in conjunction with the AC power source 73. Also, there is no malfunction in the recording operation due to external noise caused by the AC power source 73.

The DC power source 74 used herein produces the DC power upon converting the AC power supplied from the AC power source 73.

The recording head 12 includes a head portion 15, a tank portion storing hot melt ink, and ink supplying means 16*a* connecting the head portion 15 and the tank potion 16 so as to be in fluid communication with each other. The heating means is provided in association with the head portion 15, the tank portion 16 and the ink supplying means 16*a*.

According to another aspect of the present invention, a temperature detecting means may further be provided for detecting a temperature of the ink. The temperature detecting means outputs a temperature signal indicative of the temperature of the ink. Also, heat control means is provided for controlling the AC power supplying means and the DC power supplying means to be enabled in response to the temperature signal.

The heat control means may operate to enable the AC power supplying means when the temperature signal indicates that the temperature of the ink is less than a predetermined temperature, and to disable the AC power supplying means and enables the DC power supplying means when the temperature signal indicates that the temperature of the ink has reached to the predetermined temperature.

Alternatively, the heat control means may operate to enable both the AC power supplying means and the DC power supplying means when the temperature signal indicates that the temperature of the ink is less than a predetermined temperature, and to disable the AC power supplying means and enable only the DC power supplying means when the temperature signal indicates that the temperature of the ink has reached to the predetermined temperature.

Also, the heat control means may disable the AC power supplying means when the temperature signal indicates that the temperature of the ink is above a melting temperature but below an optimum temperature suitable for printing. In this case, the heat control means controls the DC power supplying means so that the optimum temperature of the ink is maintained.

By the use of temperature detecting means, fine control of the temperature of the hot melt ink can be achieved.

BRIEF DESCRIPTION OF THE DRAWINGS

The above and other objects, features and advantages of the present invention will become more apparent from the following description when taken in conjunction with the accompanying drawings, in which:

FIG. 3(*b*) is a side view showing the internal structure of the head portion of the recording head;

FIG. 5(*b*) is a side view showing the tank heater;

FIG. 5(*c*) is a bottom view showing the tank heater;

FIG. 7(*b*) is a front view showing the internal structure of the recording head;

FIG. 11(*b*) is a cross-sectional view showing the internal structure of the head according to the second embodiment of the present invention;

FIG. 12(*b*) is a bottom view showing the heater according to the second embodiment of the present invention;

FIG. 12(*c*) is a plan view showing the heater according to the second embodiment of the present invention;

FIG. 13(*b*) is a plan view showing the recording head according to the second embodiment of the present invention;

FIG. 13(*c*) is a side view showing the recording head according to the second embodiment of the present invention;

DETAILED DESCRIPTION OF THE PREFERRED EMBODIMENTS

Figure 1:
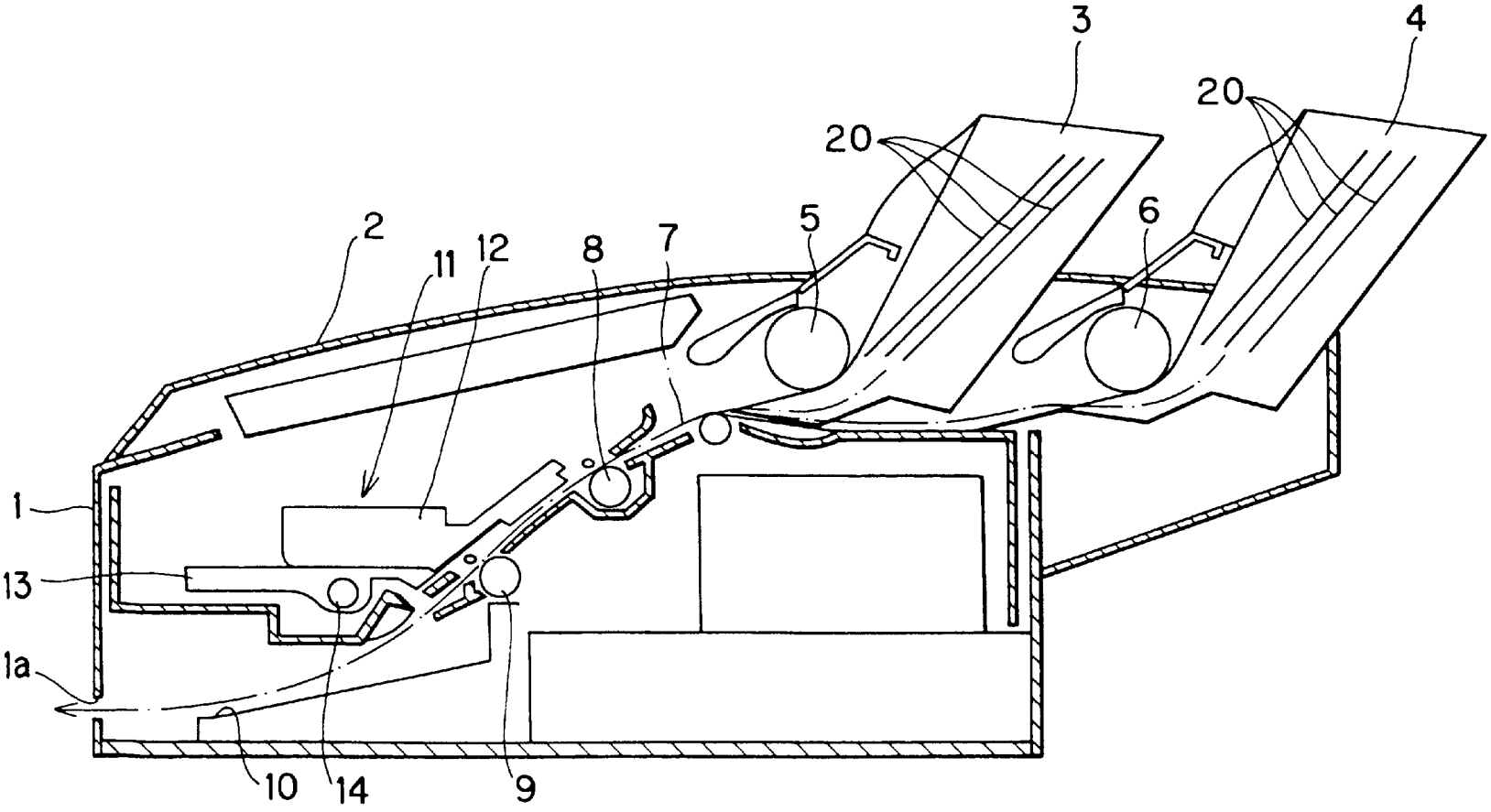
FIG. 1 is a cross-sectional view showing an ink jet recording device according to a first embodiment of the present invention.

A first embodiment of the present invention will be described while referring to FIGS. 1 through 9. In the following description, the terms "upper", "lower", "front"

and "rear" are used to designate various parts when an ink recording device is oriented in a direction in which it is used.

The ink jet recording device according to the first embodiment of the present invention is provided with a lower cover 1 and an upper cover 2 forming a housing. At the rear side of the upper cover 2, paper feed mechanisms 3 and 4 are provided one behind the other. A number of sheets of paper 20 are stacked in each of the paper feed mechanisms 3 and 4. Paper feed rollers 5 and 6 are provided in the lower portion of the paper feed mechanisms 3 and 4, respectively, and feed the paper 20 from the paper feed mechanisms 3 and 4 into a paper transportation path 7.

In the paper transportation path 7, a first conveyor roller 8, a second conveyor roller 9, a paper discharge tray 10, and a paper discharge port 1*a* are arranged in the stated order in the downstream direction (indicated by an arrow) in which the paper 20 is transported. The paper 20 is transported continuously in the downstream direction, i.e., an auxiliary scanning direction by the first and second conveyor rollers 8 and 9, and discharged from the paper discharge port 1*a* out of the device.

A recording mechanism 11 is positioned at the side of the upper cover 2 with respect to the paper transportation path 7. The recording mechanism 11 includes a recording head 12, a carriage 13 on which the recording head 12 is mounted, a guide rod 14 for slidably movably supporting the carriage 13 in a main scanning direction perpendicular to the auxiliary scanning direction, and a scanning mechanism (not shown) for moving the carriage 13 back and forth in the main scanning direction along the guide rod 14.

Figure 2A:
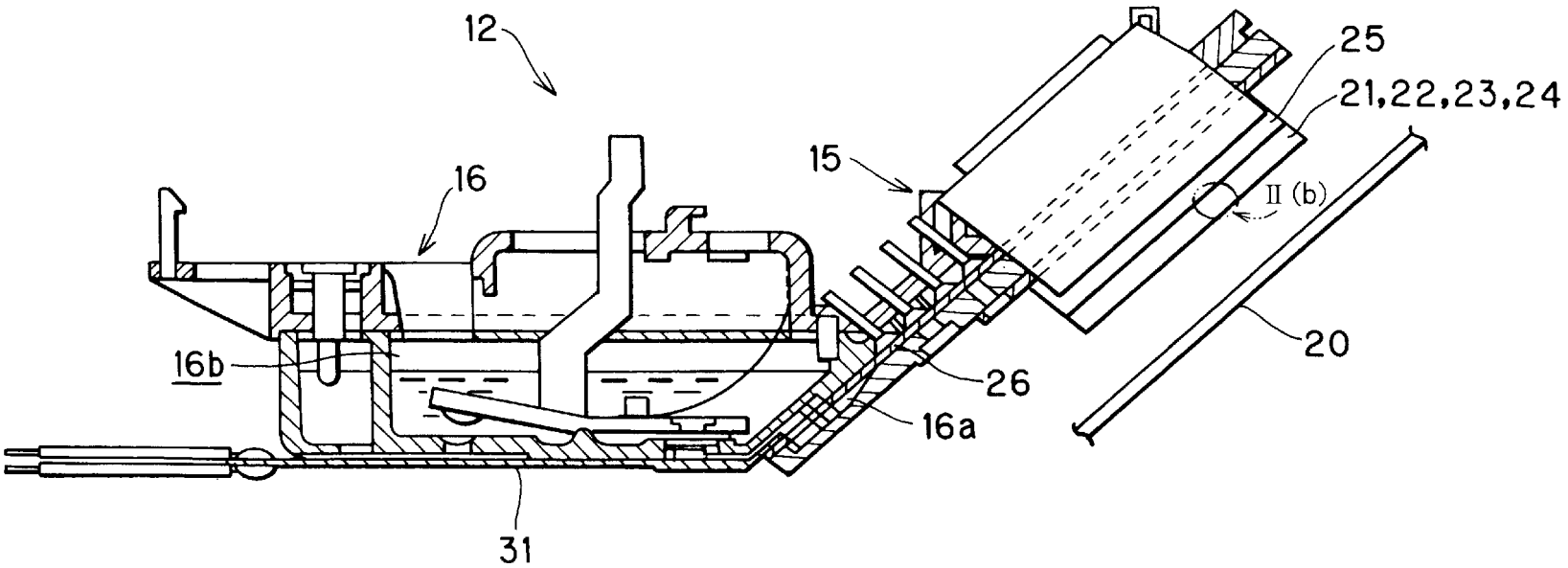
FIGS. 2(*a*) and (*b*) cross-sectional views showing the internal structure of a recording head.
Figure 2B:
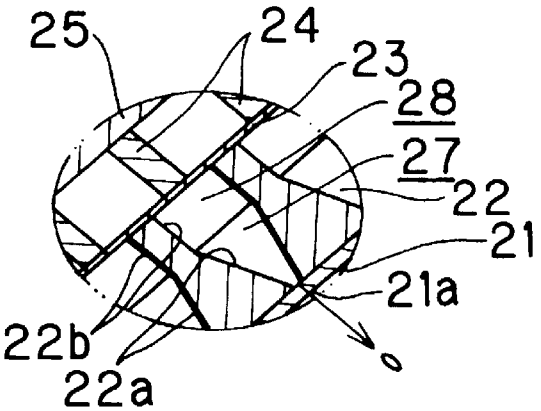

As shown in FIGS. 2(*a*) and 2(*b*) the recording head 12 has a head portion 15 for ejecting hot melt ink and a tank portion 16 for storing the hot melt ink to be supplied to the head portion 15. The hot melt ink used in the ink jet recording device has such properties that it solidifies at room temperature and has a softening point in a temperature range of 40 to 140° C., a melting point in a temperature range of 50 to 150° C., and an ink viscosity of 3 to 50 cps at ejection. It is desirable that the ink be made from 30 to 90% wax, 5 to 70% resin, 0.1 to 10% colorant, and other additives (such as viscosity-raising agents, surface-active agents and melting agents).

Figure 3A:
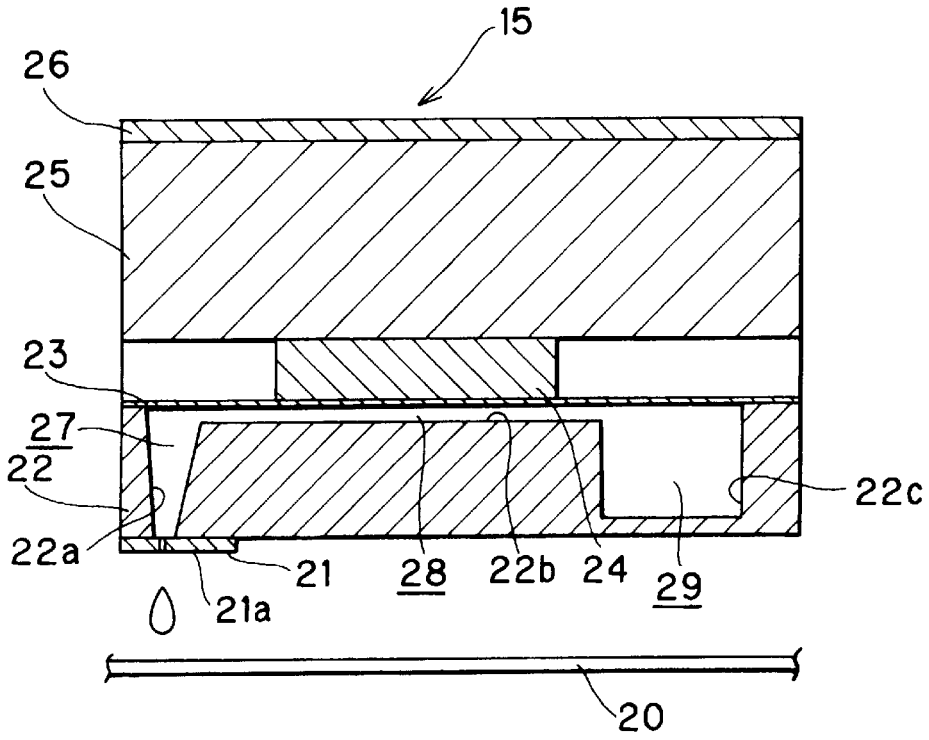
FIG. 3(*a*) is a front view showing the internal structure of the head portion of the recording head.
Figure 3B:
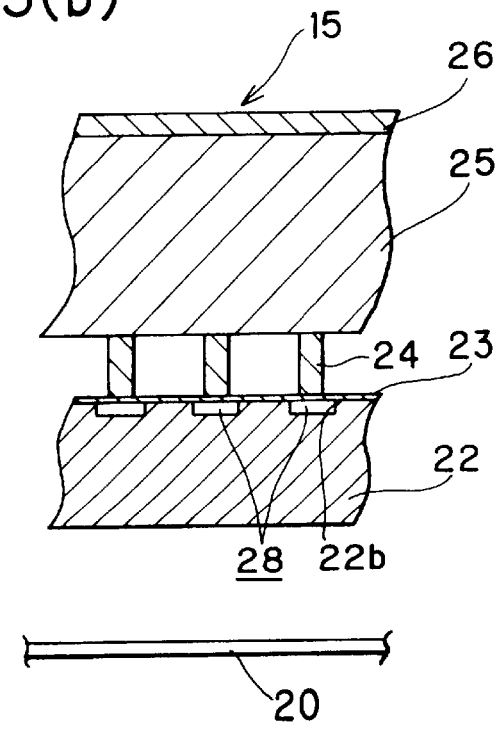

As shown in FIGS. 3(*a*), 3(*b*) and 4, a head portion 15 has a nozzle plate 21 facing the paper 20. The nozzle plate 21 is formed with a plurality of nozzles 21*a* aligned in the auxiliary scanning direction. The nozzle plate 21 is bonded to a cavity plate 22. The cavity plate 22 is formed with a plurality of ink ejection grooves 22*a* and ink chamber grooves 22*b* corresponding to respective nozzles 21*a*, and an ink supply groove 22*c* connected to the respective ink chamber grooves 22*b*.

A diaphragm 23 covers the surface of the cavity plate 22 to close off the upper surface of each groove 22*a*, 22*b*, and 22*c* of the cavity plate 22, thereby forming nozzle chambers 27, ink chambers 28, and an ink supply chamber 29. Further, a plurality of piezoelectric elements 24 supported on a base plate 25 are attached to the diaphragm 23 so that each piezoelectric elements 24 is positioned above the ink chamber 28 through the diaphragm 23.

The piezoelectric elements 24 are made from plumbic zircon titanium (PZT), and polarized by applying a predetermined voltage (for example, 80V) under a predetermined temperature (for example, 130° C.). This polarizing treatment is effected during manufacture of the recording head 12. Further, each of the piezoelectric elements 24 is formed with at least one pair of electrodes for applying a drive voltage thereto. The polarities of the driving voltage is to be in coincidence with the polarized direction of the piezoelectric elements 24. When an electric field with a direction in coincidence with the polarized direction of the piezoelectric elements is applied to the polarized piezoelectric elements, they extend to a direction perpendicular to the lengthwise direction of the piezoelectric elements, thus contract in the lengthwise direction thereof. When a voltage is applied to the piezoelectric elements 24 through the electrodes, the piezoelectric element 24 extends and contracts corresponding to the applied drive voltage. The diaphragm 23 to which the piezoelectric element 24 is attached displaces in the vertical direction, thereby changing the volume of the ink chamber 28. As a result, the ink is ejected from the nozzle 21*a* toward the paper 20 in accordance with the drive voltage.

Figure 4:
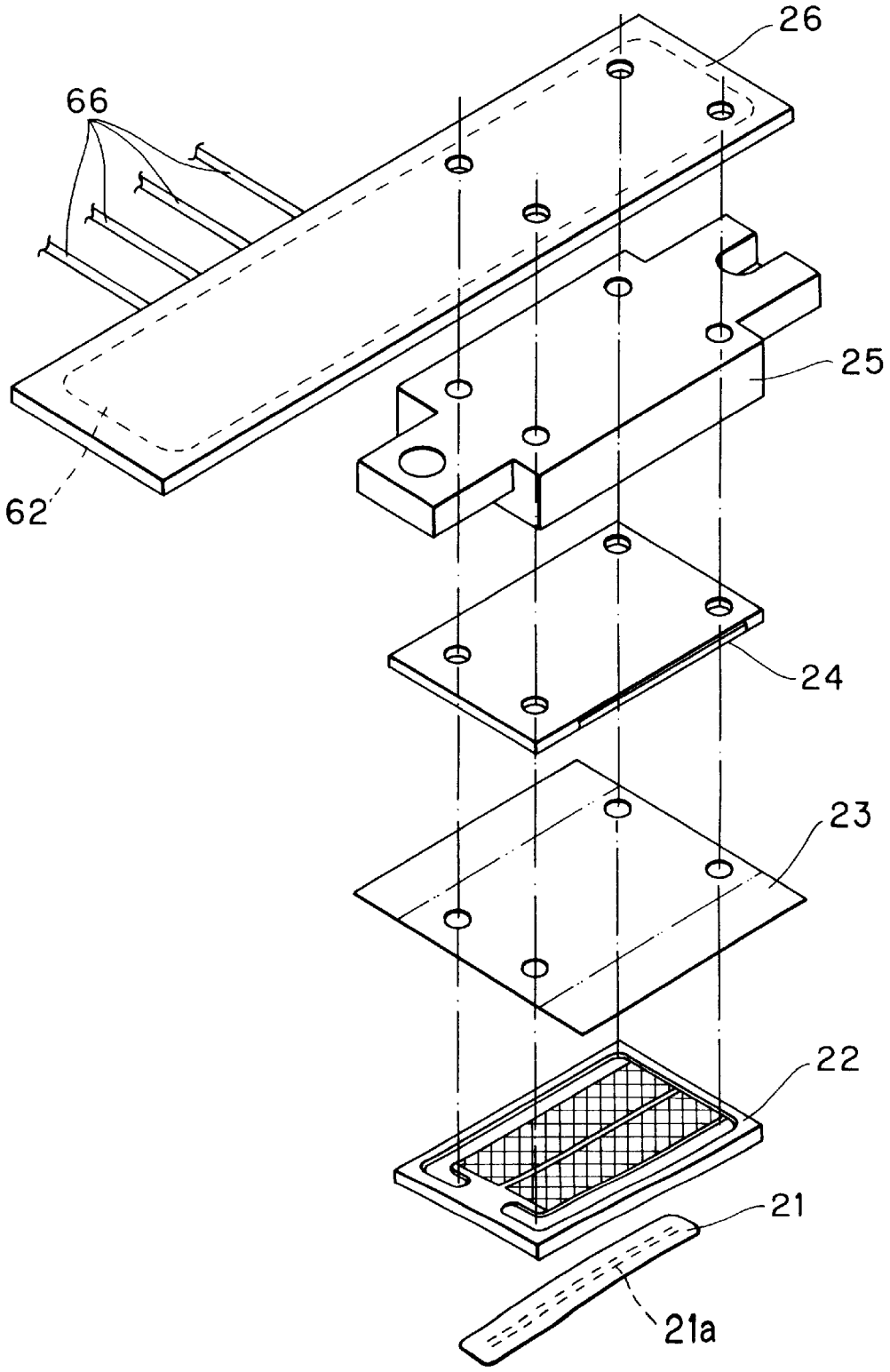
FIG. 4 is a fragmented perspective view showing the head portion of the recording head.
Figure 5A:
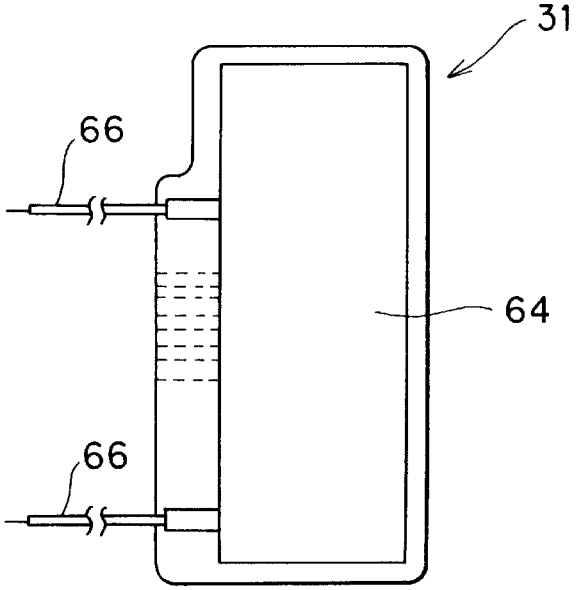
FIG. 5(*a*) is a plan view showing a tank heater.
Figure 5B:
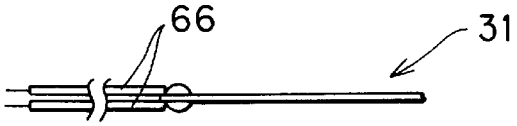
Figure 5C:
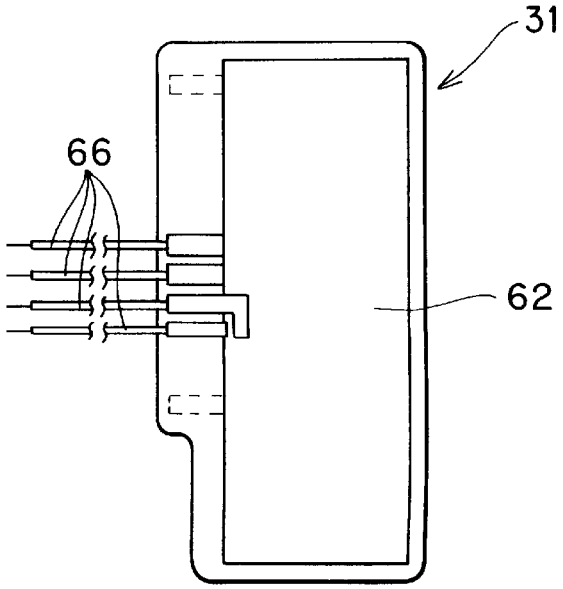

As best shown in FIG. 4, a plate-shaped front heater 26 is attached to one surface of the base plate 25. To the opposite surface of the base plate 25, the piezoelectric elements 24 are attached. As shown in FIGS. 2(*a*) and 2(*b*) the front heater 26 extends outwardly from the base plate 25 to the ink supply channel 16*a* of the tank portion 16, and heats the piezoelectric elements 24 and the hot melt ink in the ink supply chamber 29 through the base plate 25, and also heats the hot melt ink in the ink supply channel 16*a*.

The ink supply channel 16*a* is in fluid communication with an ink reservoir 16*b* in the tank portion 16 so that the hot melt ink stored therein is fed into the ink supply chamber 29. As shown in FIGS. 2(*a*), 2(*b*), 5(*a*), 5(*b*) and 5(*c*), a tank heater 31 is attached to the bottom wall of the ink reservoir 16*b*. The tank heater 31 heats and melts the hot melt ink in ink reservoir 16*b*.

Figure 6:
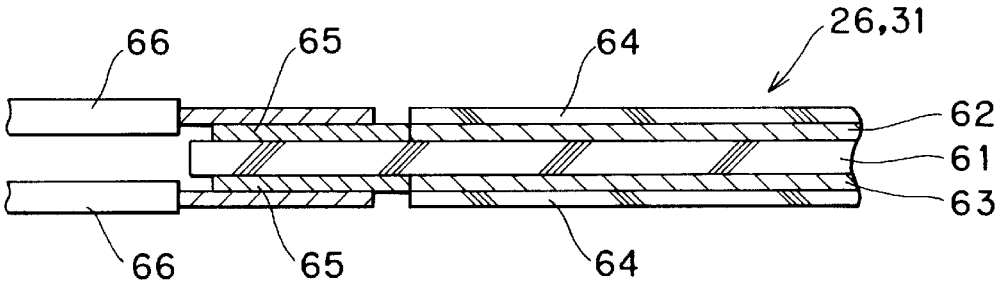
FIG. 6 is a vertical cross-sectional view showing the structures of the tank heater and front heater.

As shown in FIG. 6, each of the front heater 26 and the tank heater 31 includes a plate-shaped base member 61, an AC heater section 62 formed on one side of the base member 61, a DC heater section 63 formed on the other side of the base member 61, and protection members laminated over the AC heater section 62 and the DC heater section 63. The base member 61 is made from an insulating material such as alumina. The AC heater section 62 and the DC heater section 63 are made from a heat-generating material, such as ruthenium oxide. The protection members 64 are made from lead glass. Electrode members 65 made from silver-palladium (Ag—Pd) are formed on both sides of the base member 61 and connected to the AC heater section 62 and DC heater section 63, respectively. The electrode members 65 are also connected to lead wires 66, respectively, so that AC power and DC power are supplied respectively to the AC heater section 62 and the DC heater section 63 through lead wires 66 and electrode members 65.

Figure 9:
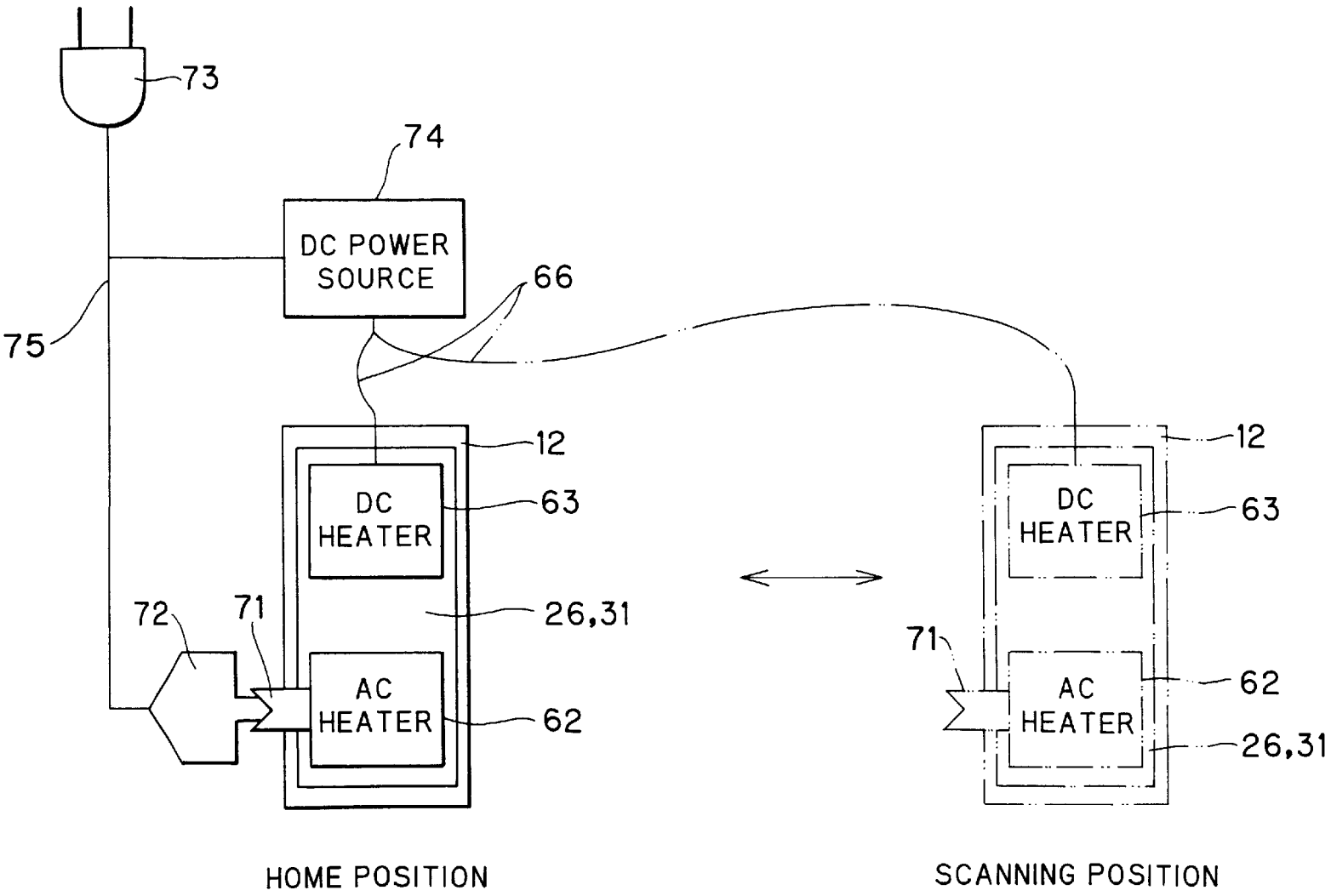
FIG. 9 is an explanatory diagram showing the operational states of the ink jet recording device.

The DC heater sections 63 of the front heater 26 and the tank heater 31 generate the minimum thermal output required to maintain the hot melt ink in a molten state. Each of the DC heater sections 63 is, as shown in FIG. 9, connected via the lead wire 66 to a DC power source 74 provided inside the housing. Power is supplied from the DC power source 74 to the DC heater sections 63 when the ink jet recording device stays in ON state regardless of whether the carriage 13 is in a home position or a scanning position.

Figure 7A:
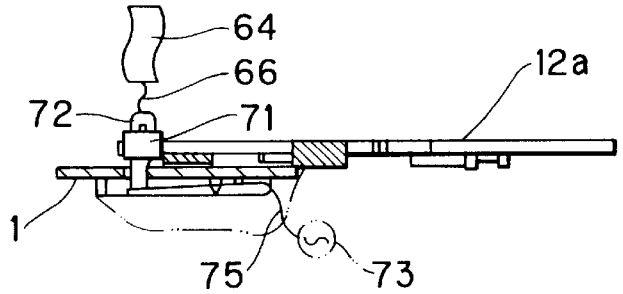
FIG. 7(*a*) is a plan view showing the internal structure of the recording head.
Figure 7B:
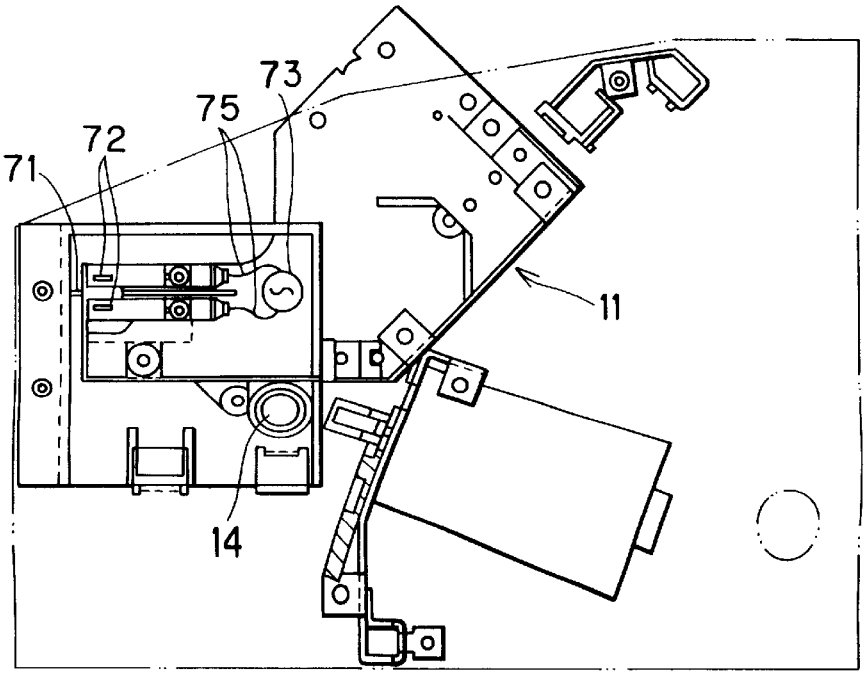

On the other hand, the AC heater sections 62 of the front heater 26 and the tank heater 31 generate a thermal output capable of rapidly melting the solid-state hot melt ink. As shown in FIGS. 7(*a*) and 7(*b*), the AC heater sections 62 are connected to a socket 71 via lead wiring 66. The socket 71 is provided on a side wall 12*a* of the recording head 12 and a plug 72 is provided on the side wall of the lower cover 1.

When the recording head 12 is moved to the home position, the plug 72 is brought to engagement with the socket 71. On the other hand, when the recording head 12 is in the scanning position, the plug 72 is disengaged from the socket 71. The plug 72 is connected to an AC power source 73 via an electromagnetic switch (not shown) and a reinforced wiring 75 of a dual insulation structure. The AC power source 73 supplies power to the AC heater sections 62 of the front heater 26 and to the tank heater 31 only when the recording head 12 is at the home position where the socket 71 and the plug 72 are in engagement with each other.

Figure 8:
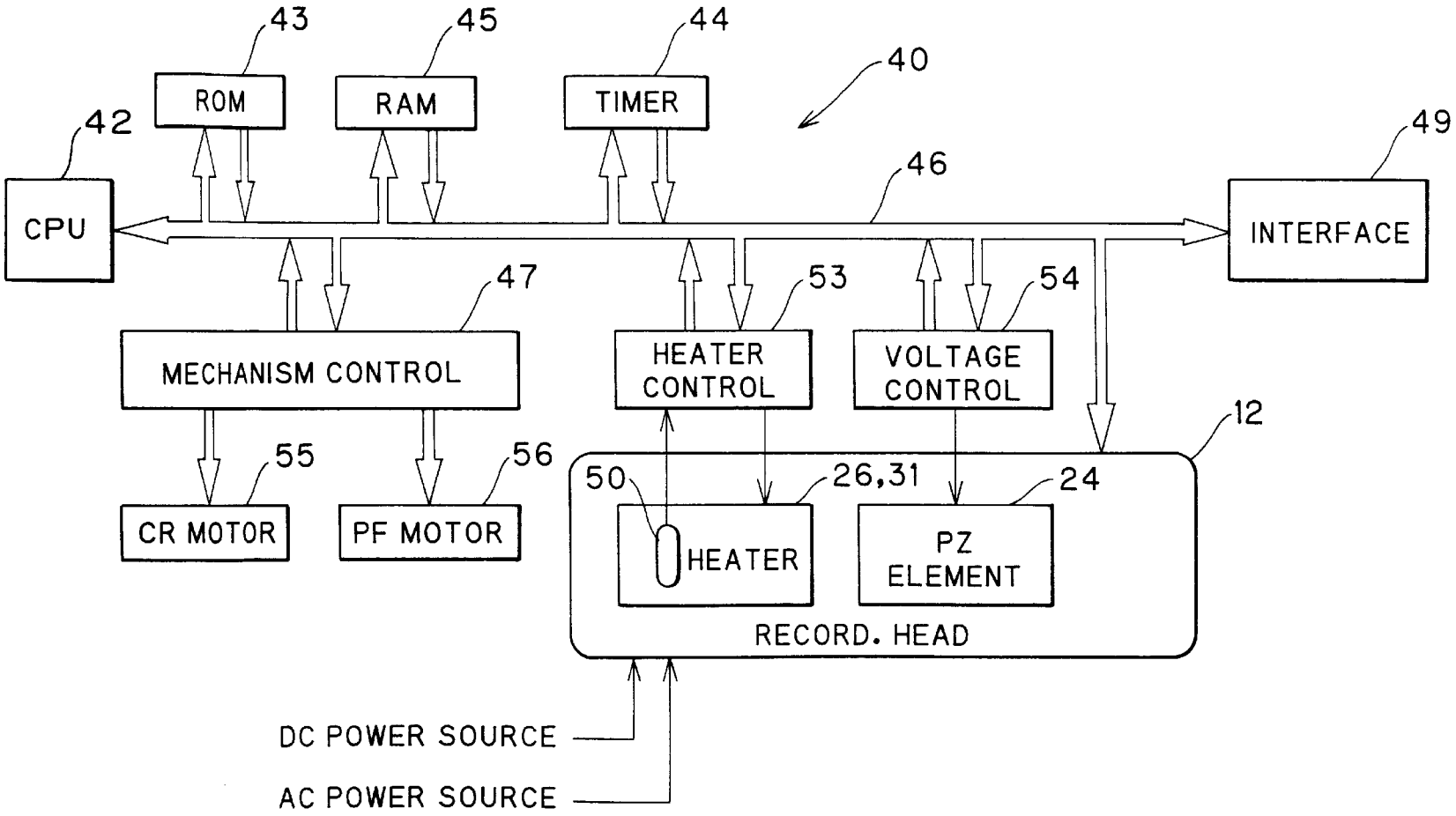
FIG. 8 is a block diagram showing the control system of the ink jet recording device.

As shown in FIG. 8, the recording mechanism 11 including the front heater 26, the tank heater 31, and the piezoelectric (PZ) elements 24 is controlled by a recording device control system 40. The control system 40 includes a central processing unit (CPU) 42, a read-only memory (ROM) 43, a random access memory (RAM) 45, a timer 44, an interface 49, a mechanism control section 47, a heater control section 53, and a voltage control section 54 which are mutually connected to one another via a bus 46.

The ROM 43 stores various control programs, such as printing routines for printing dot data stored in an output data storage region. The RAM 45 has the output data storage region for storing the dot data in a matrix data table defined by addresses of the main scanning direction and addresses of the auxiliary scanning direction. The timer 44 outputs time data indicating the current time. The interface 49 is connected to an information processing device, such as a personal computer (not shown), and inputs information data, such as image data, from the information processing device to the control system 40.

The mechanism control section 47 is connected to a carriage (CR) motor 55 for moving the recording head 12 in the main scanning direction and also to a paper feed (PF) motor 56 for feeding the paper 20 in the auxiliary scanning direction. The heater control section 53 is connected to the front heater 26 and tank heater 31 shown in FIGS. 2(*a*) and 2(*b*). The heater control section 48 controls the heaters 26 and 31 so as to be at predetermined temperature in response to the output from thermisters 50 provided in association with the front heater 26 and the tank heater 31. The voltage control section 54 generates a driving voltage to be applied to the piezoelectric elements 1 of the recording head 12.

During the printing operations at which the recording head 12 is at a scanning position, the hot melt ink is maintained at the molten-state by the DC heater sections 63 of the front heater 26 and tank heater 31, and the control system 40 prints the dot data on the paper 20 on a band basis while moving the recording head 12 in the main scanning direction by the CR motor 55 and feeding the paper 20 in the auxiliary scanning direction by the PF motor 56. When the recording head 12 is powered, it is at the home position. In this condition, the hot melt ink is heated by the DC heater section 63 and the AC heater section 62 in each of the heaters 26 and 31. By energizing the AC heater sections 62 in the heaters 26 and 31, the solid-state ink is melted quickly.

The operation of the ink jet recording device with the above-described configuration will be described.

As shown in FIG. 9, when the recording head 12 is at the home position, the plug 72 provided on the lower cover 1 is in engagement with the socket 71 provided on the recording head 12. When the recording device is powered, the AC heater sections 62 of the heaters 26 and 31 are energized via the reinforced wiring 75, the plug 72, and the socket 71. At the same time, the DC power source 74 is also energized by the AC power source 73 via the reinforced wiring 75. The AC voltage is converted to the DC voltage by the DC power source 74, and the resultant voltage is supplied to the DC heater sections 63 of the heaters 26 and 31 via the lead wires 66.

Accordingly, the hot melt ink in the head portion 15 is rapidly heated to a molten state by the high thermal output generated by the AC heater section 62 and the DC heater section 63 of the front heater 26. Also, the hot melt ink in the tank portion 16 is rapidly heated to a molten state by the high thermal output generated by the AC heater section 62 and the DC heater section 63 of the tank heater 31. Therefore, startup of the device can be attained in a short period of time, and the hot melt ink is maintained in a molten state at the predetermined temperature by virtue of the AC heater sections 62 and the DC heater sections 63 until printing operations are performed.

To perform printing, the mechanism control section 47 moves the recording head 12 in the main scanning direction by the CR motor 55, and the voltage control section 54 applies a drive voltage to the piezoelectric elements 24 based on the dot data stored in the output data storage region of the RAM 45. Thus, the piezoelectric elements 24 extend and contract in response to the drive voltage. The diaphragm 23 displaces vertically to change the volume of ink chamber 28, thereby ejecting the ink in ink chamber 28 toward the paper 20 through the nozzle chamber 27 and the nozzle 21*a*. After the recording head 12 completes one band worth of printing while moving in the main scanning direction, the PF motor 56 feeds the paper 20 by one band worth of distance in the auxiliary scanning direction, and then printing for the next line is carried out. Subsequently, after the whole printing on the paper 20 is completed, the paper 20 is discharged out of the device through the paper transportation path 7 and the paper discharge port 1*a*.

When the recording head 12 is printing, that is, it is in the scanning position, the socket 71 is disengaged from the plug 72 so that no power is supplied to the AC heater section 62 from the AC power source 73. Because power is supplied to the DC heater sections 63 of the front heater 26 and tank heater 31 only from the DC source 74, the hot melt ink is heated only by the DC heater sections 63. The DC heater sections 63 generate the minimum thermal output required to maintain the hot melt ink at the molten state. During movement of the recording head 12 in the main scanning direction, the lead wires 66 connected to the recording head 12 may impair the stability in the scanning of the recording head 12. However, since the lead wiring 66 is much finer and more flexible than the reinforced wiring 75 for the AC power, there is no reduction in the scanning stability of the recording head 12. Further, even if the external noise is caused by the AC power source 73, since the plug 72 and the socket 71 are disengaged from each other during the scanning operation of the recording head 12, there is no malfunction in the printing operation due to external noise.

According to the first embodiment, both the AC heater 62 and the DC heater 63 are energized when the recording head 12 is at the home position. The first embodiment can be modified so that only the AC heater 62 is energized at the time of startup or when the recording head is at the home position.

A second embodiment of the present invention will next be described while referring to FIGS. 10 through 15. The second embodiment is concerned with a color ink jet recording device which carries out printing by ejecting several colors of ink. Similar to the first embodiment, each color ink is a hot melt type and the recording head is actuated with piezoelectric elements.

Figure 10:
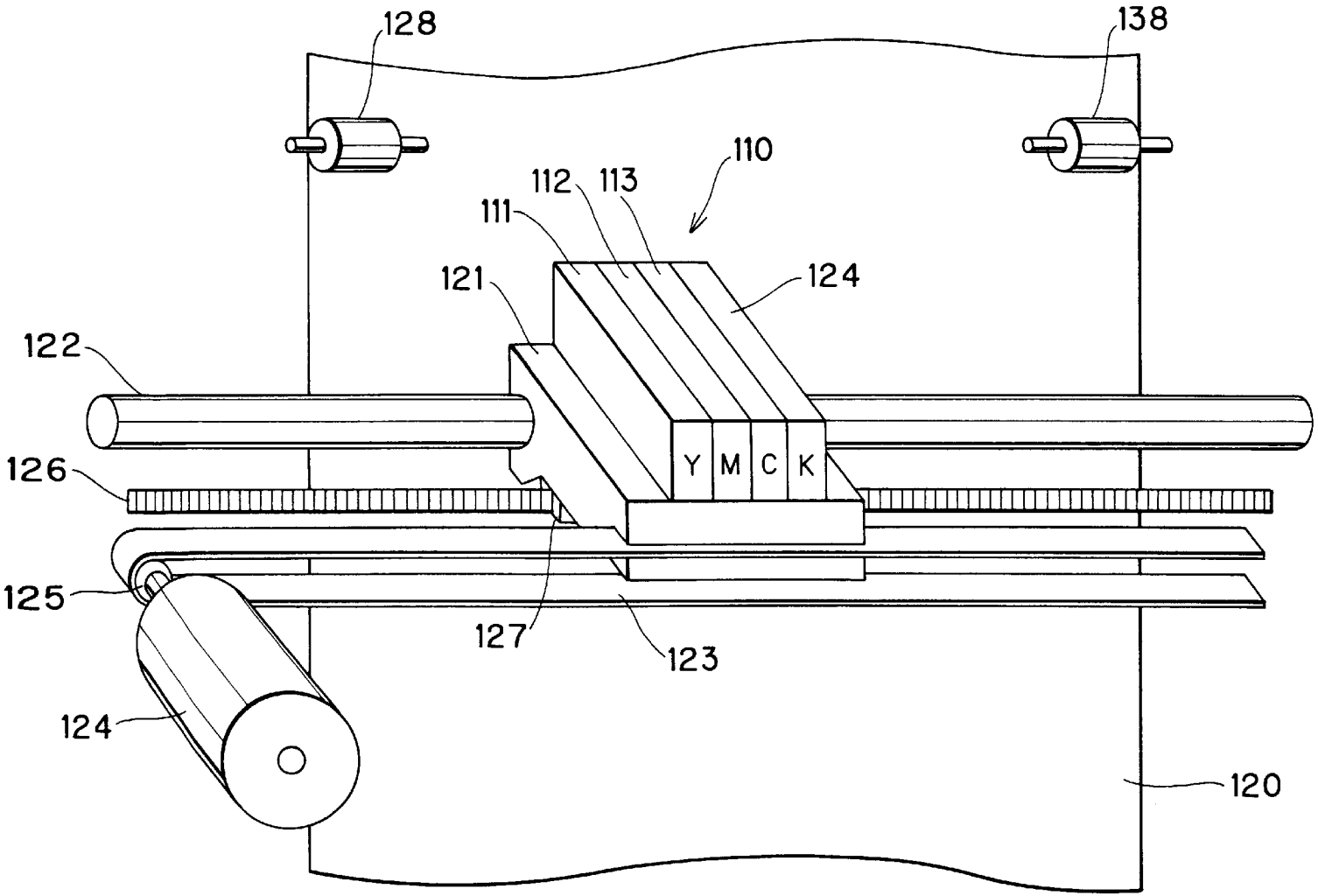
FIG. 10 is a perspective view showing a moving mechanism of a recording head according to a second embodiment of the present invention.

As shown in FIG. 10, the recording device is provided with a recording head 110. The recording head 110 includes a yellow head 111 for ejecting yellow ink, a magenta head 112 for ejecting magenta ink, a cyan head 113 for ejecting cyan ink, and a black head 114 for ejecting black ink. Ink chambers (not shown) are provided internally of the recording head 110 corresponding to the respective color heads. Four kinds of color ink are filled with the ink chambers. Each ink chamber has an ink ejection nozzle and a piezoelectric element serving as an energy-generating means for changing the volume of the ink chamber. Four ink tanks 150 for storing four kinds of hot melt ink are connected to the heads 111 through 114, respectively. The structure of the ink tank 150 will be described later with reference to FIGS. 11(*a*) and 11(*b*).

The recording head 110 is mounted on a carriage 121. A guide rod 122 which extends horizontally (main scanning direction) is inserted through the carriage 121 so that the carriage 121 is slidably movable therealong. A timing plate 126 marked with a plurality of slits (graduations) extends in parallel with the guide rod 122. An encoder element 127 for detecting the slits marked on the timing plate 126 is provided on the front lower portion of the carriage 21 so as to be movable with the carriage 21. An endless belt 123 is stretched in parallel with the timing slit 126 and a portion of the endless belt 123 is attached to the lower side of the carriage 121. The endless belt 123 engages a pulley 125 of a CR motor 124. The carriage 121, the guide rod 122, the endless belt 123 and the CR motor 124 form a carriage mechanism 145 (see FIG. 14). Incidentally, the recording head of the first embodiment is also constructed in the similar fashion to the one described above.

A recording paper 120 is sandwiched between paper feed rollers (not shown) rotated by a line feed (LF) motor 129 (see FIG. 14) and pressure rollers 128 provided opposite to the paper feed rollers. The recording paper 120 is thereby fed in a vertical direction (auxiliary scanning direction).

Figure 11A:
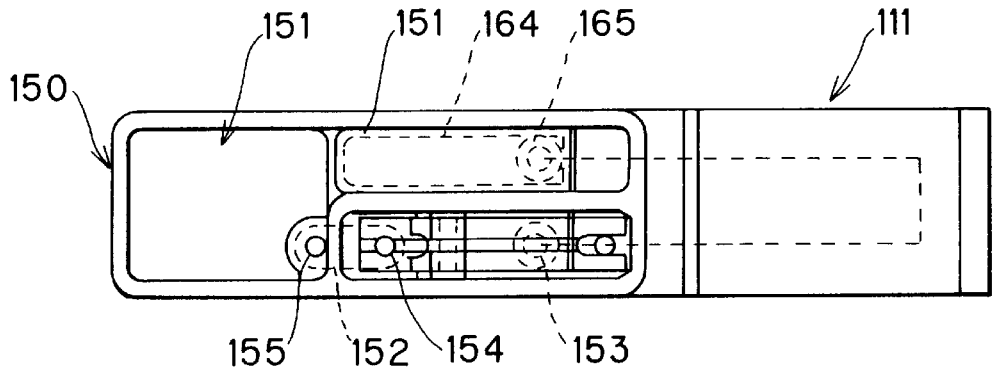
FIG. 11(*a*) is a plan diagram showing the internal structure of a head according to the second embodiment of the present invention.
Figure 11B:
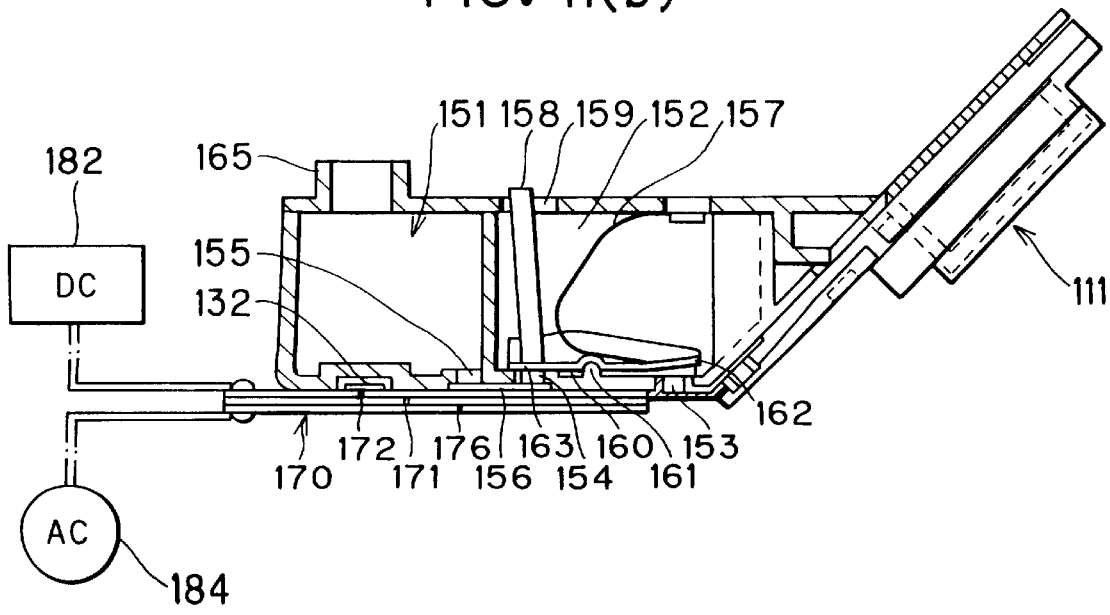

Next, the structure of the heads 111 and 114 will be described while referring to FIGS. 11(*a*) and 11(*b*). FIG. 11(*a*) is a plan view of the head 111 as viewed from the top and FIG. 11(*b*) is a vertical cross-sectional view of the head 111 as viewed from the right-hand side in FIG. 10. Since each head has the same structure, only the yellow head 111 having an ink tank 150 therein will be described.

The ink tank 150 is divided into a primary chamber 151 for storing heated and melted ink to be supplied to the head 111 and a secondary chamber 152 for storing ink recycled from the head 111. A first inlet opening 153 is formed in the bottom of the secondary chamber 152 for introducing the ink recycled from the head 111 into the secondary chamber 152. A first outlet opening 154 is also formed in the bottom of the secondary chamber 152 for discharging the ink contained in the secondary chamber 152 into the primary chamber 151. A connecting channel 156 connects the first outlet opening 154 and a second inlet opening 155 formed at the bottom of the primary chamber 151. Also, an air supply opening 165 is formed in the upper portion of primary chamber 151. A hose used for in conjunction with a purging pump (to be described later) is connected to the air supply opening 165.

A plate-shaped valve 160 is provided in the bottom portion of the secondary chamber 152 for opening and closing the first inlet opening 153 and the first outlet opening 154. The valve 160 is supported at the center portion of its under surface by a supporting section 161 protruded from the bottom of the secondary chamber 152. One end 162 of the valve 160 is urged in a direction closing off the first inlet opening 153 by means of a leaf spring 157 fixedly attached to the upper side of the secondary chamber 152. A lever 158 is attached to the other end 163 of the valve 160. The lever 158 is projecting through a groove 159 formed in the upper side of the secondary chamber 152. When the lever 158 is depressed, the first inlet opening 153 opens and at the same time, the first outlet opening 154 closes.

Figure 13A:
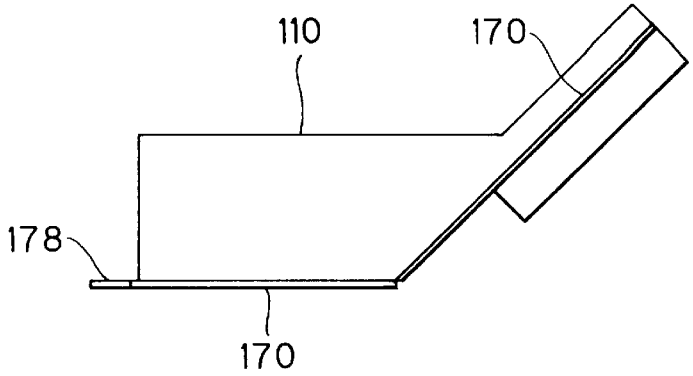
FIG. 13(*a*) is a side view showing the recording head according to the second embodiment of the present invention.
Figure 13B:
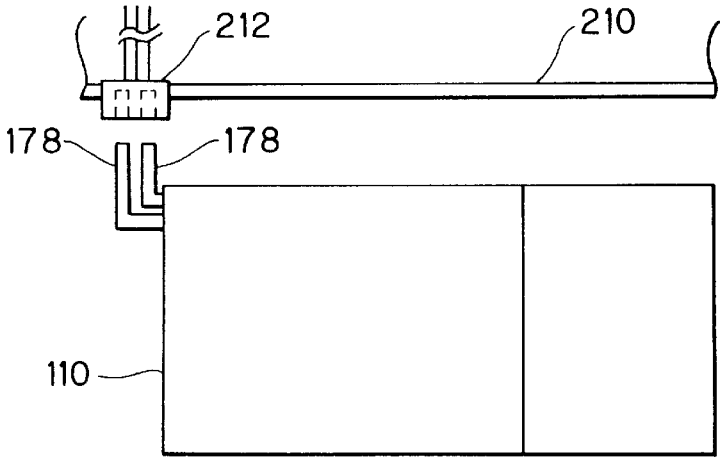
Figure 13C:
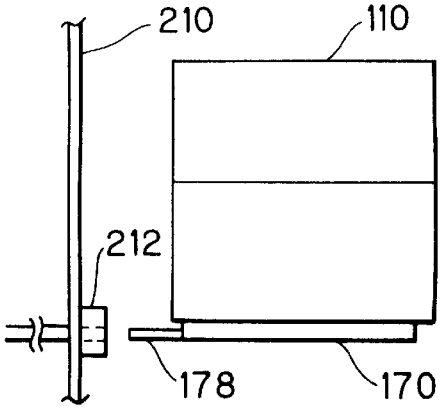

As shown in FIG. 13(*a*), the primary chamber 151 is provided with a filter 164 for preventing impurities and air bubbles contained in the ink from entering the recording head 111. A second outlet opening 165 is formed inside the filter 164. The ink in the primary chamber 151 is fed to the head 111 through the second outlet opening 165. A temperature sensor 132 for detecting the temperature of the ink in the primary chamber 151 is embedded in the bottom of the primary chamber 151. As shown in FIG. 11(*b*), a heater 170 for heating and melting the ink in the primary and secondary chamber 151 and 152, and for maintaining the ink in a molten state is attached to the underside of ink tank 150.

Figure 12A:
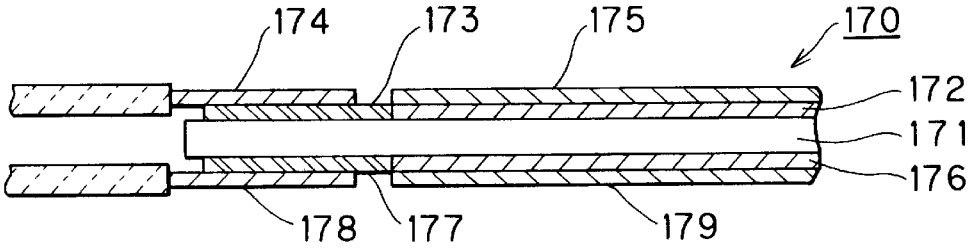
FIG. 12(*a*) is a cross-sectional view showing the heater according to the second embodiment of the present invention.
Figure 12B:
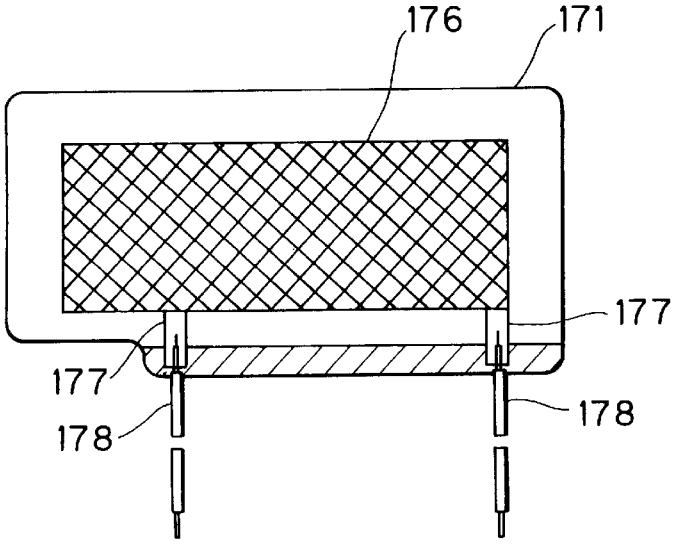
Figure 12C:
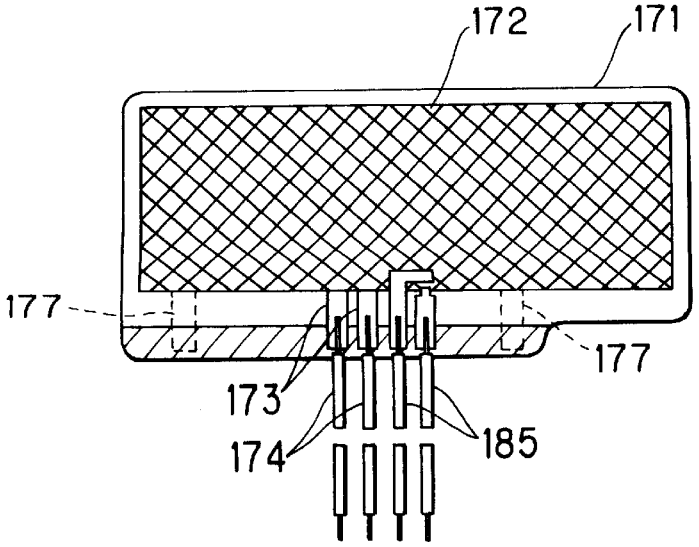

Next, ink heating means will be described while referring to FIGS. 11(*b*) and 12(*a*) through 12(*c*). FIG. 12(*a*) is a cross-sectional view of the heater 170. FIG. 12(*b*) is a bottom view of the heater 170 as viewed from the left-hand side in FIG. 12(*a*). FIG. 12(*c*) is a plan view of the heater 170 as viewed from the left-hand side in FIG. 12(*a*).

As shown in FIG. 12(*a*), the heater 170 is provided with a plate-shaped base member 171 made from an insulating material. A DC heater section 172 for keeping the temperature of the ink or maintaining the molten state of the ink is disposed in the form of a film on the upper surface of the base member 171. Film electrodes 173 are disposed on the upper surface of the base member 171 as shown in FIG. 12(*c*). Each electrode 173 is electrically connected to the DC heater section 172 and to a corresponding lead wire 174. As shown in FIG. 11(*b*), the lead wires 174 are electrically connected to a 40V DC power source 182 provided interiorly of the recording device. A protective layer 175 made from an insulating material is formed to cover the DC heater section 172. The DC heater section 172 contacts the underside of ink tank 150 through the protective layer 175.

An AC heater section 179 is disposed on the underside of the base member 171 as shown in FIG. 12(*b*). Similar to the DC heater section 172 and its associated elements, the AC heater section 176 and electrodes 177 are electrically connected to each other. Each electrode 177 is electrically connected to a corresponding lead wire 178. As shown in FIG. 11(*b*), the lead wires 178 are connected directly to a 100V AC power source 184. A protective layer 179 made from an insulating material is also formed on a surface of the AC heater section 176. Lead wires 185 are connected to the temperature sensor 132 and to the AC heater section 176.

As described, the heater 170 has a dual structure wherein the DC heater section 172 for maintaining temperature of the ink is formed on the upper side of the base member 171 and the AC heater section 176 for melting ink is formed on the underside thereof.

In the second embodiment of the invention, the power consumption of the DC heater section 172 and the AC heater section 176 is 50 W and 100 W, respectively. Similar to the first embodiment, both sections are made from ruthenium oxide. The base member 171 is made from alumina, and its size is 80 mm in width, 40 mm in depth, and 0.6 mm in thickness when assembled to the head 111. The protective layers 175 and 179 are made from lead glass, and the electrodes 173 and 177 are made from Ag—Pd. The ink tank 150 is made from aluminum. The thermistor is used for the temperature sensor 132.

Referring to FIGS. 13(*a*) through 13(*c*), description will be made with respect to supply of the AC power to the AC heater section 176. FIG. 13(*a*) is a side view of the recording head 110. FIG. 13(*b*) is a plan view thereof, and FIG. 13(*c*) is a left-hand side view thereof. As will be described later, the AC power is supplied to the AC heater section 176 in exactly the same manner as in the first embodiment. In the following description, the melting point of the ink used in this embodiment is assumed to be 90° C.

As shown in FIGS. 13(*b*) and 13(*c*), a socket 212 connected to a 100V AC power source 184 is provided on a frame 210 (which corresponds to the lower cover 1 shown in FIG. 1) of the recording device. When the recording head 110 moves toward the frame 210, the lead wires 178 on the recording head 110 are brought to engagement with the socket 212. That is, when the recording device is powered, the lead wires 178 are connected to the socket 212, thereby causing to flow a 100V AC current through the AC heater section 176. The solid state ink contained in the ink tank 150 is thus melted in a short period of time by the high thermal output generated from the AC heater section 176.

Figure 14:
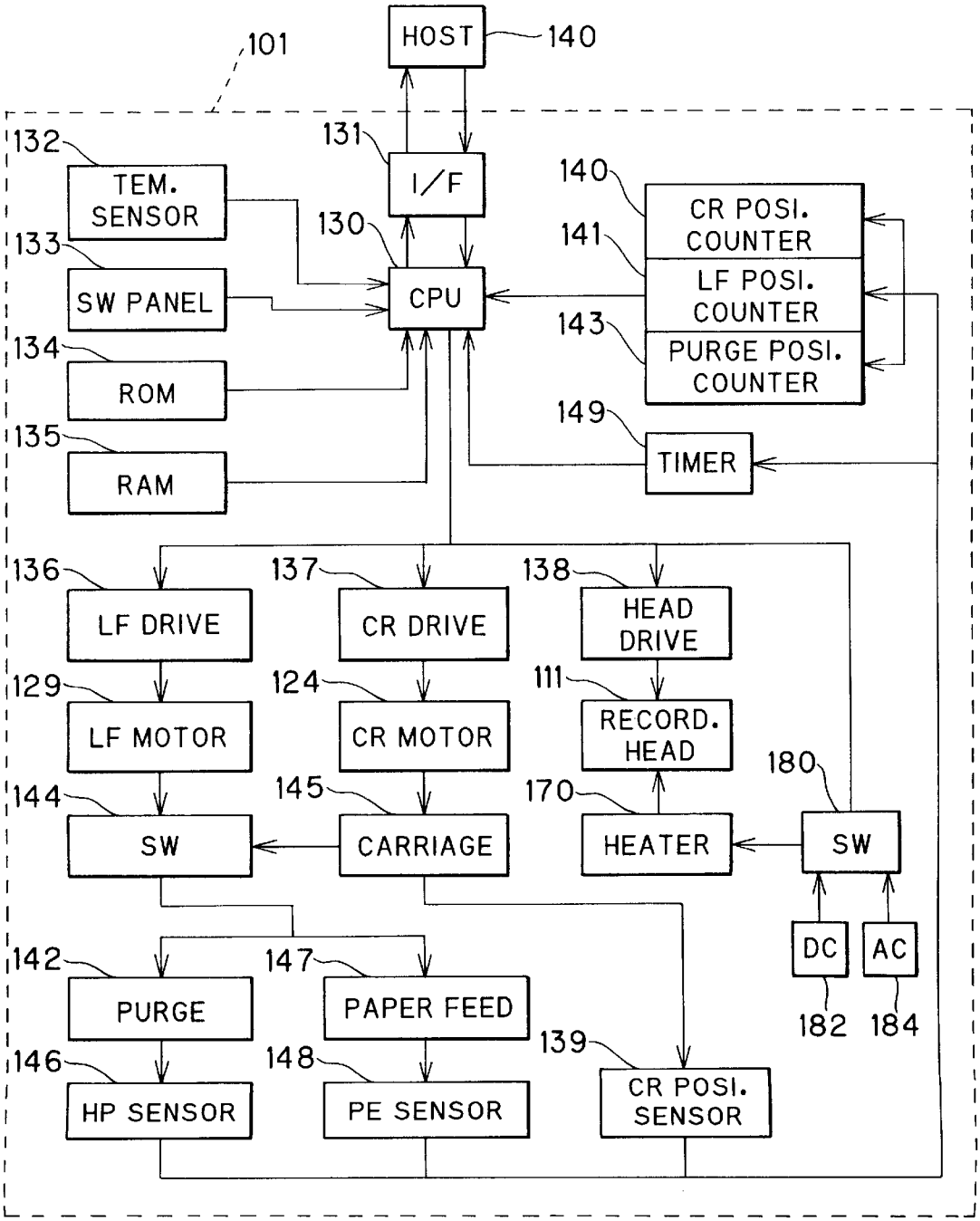
FIG. 14 is a block diagram showing the control system of the ink jet recording device according to the second embodiment of the present invention.

Next, a control system of the recording device will be described while referring to FIG. 14.

The control system of the recording device 101 includes a CPU 130 for executing various processing as will be described later. The CPU 130 is connected to an interface (I/F) 131, the temperature sensor 132, a switch panel 133, a ROM 134, and a RAM 135. The interface 131 converts signals from a host computer 140 into signals used in the processing of the CPU 130. The temperature sensor 132 detects the temperature of ink in the ink tank 150 as described previously. The switch panel 133 indicates an operational state of the recording device by LEDs. Various control programs are stored in the ROM 134.

Recording data fed from the host computer 140 through the interface 131 is temporarily stored in the RAM 135. Then, the CPU 130 produces driving data for driving the LF motor 129, the CR motor 124, and the head 111 based on the recording data and a recording program installed in the ROM 134.

Of the driving data, LF motor drive data for driving the LF motor 129 is input to an LF drive circuit 136, so that an LF motor 129 is driven in accordance with LF motor drive signals from the LF drive circuit 136. In other words, the recording paper 120 is fed in a vertical direction by driving the LF motor 129. CR motor drive data for driving the CR motor 124 is input to a CR drive circuit 137 so that the CR motor 124 is driven in accordance with CR motor drive signals from the CR drive circuit 137. In other words, the carriage 121 moves back and forth along the guide rod 122 in the main scanning direction by driving the CR motor 124. Also, recording head drive data for driving the head 111 is input to a head drive circuit 138. The head 111 is driven in accordance with recording head drive signals from the head drive circuit 138. That is, when the head drive signal is input to the head 111, a voltage is applied to a piezoelectric element (not shown). The piezoelectric element extends and contracts in accordance with the voltage applied thereto, thereby causing to displace a diaphragm stretched over an ink chamber (not shown). Ink in the ink chamber is pressurized and ejected from a nozzle.

Connected to the CPU 130 are a CR position counter 140 for inputting and counting pulse signals from a CR position sensor 139, an LF position counter 141 for detecting a paper feed amount of the printing paper 120 fed by the LF motor 129 and the paper feed mechanism 147, and a purging position counter 143 for detecting the rotational position of a cam for driving a purging mechanism 142. The CPU 130 calculates the position of the head 111 and the rotational position of the cam based on data detected by the counters. Also, the control system further includes a switching mechanism 144 for switching from the purging mechanism 142 to the paper feed mechanism 147 and vice versa, a home position (HP) sensor 146 for detecting that the carriage 121 has returned to the original position, and a paper empty (PE) sensor 148 for detecting presence of the printing paper 120.

Next, control process of the heater 170 executed by the CPU 130 will be described while referring to the flowcharts of FIGS. 15 and 16.

Figure 15:
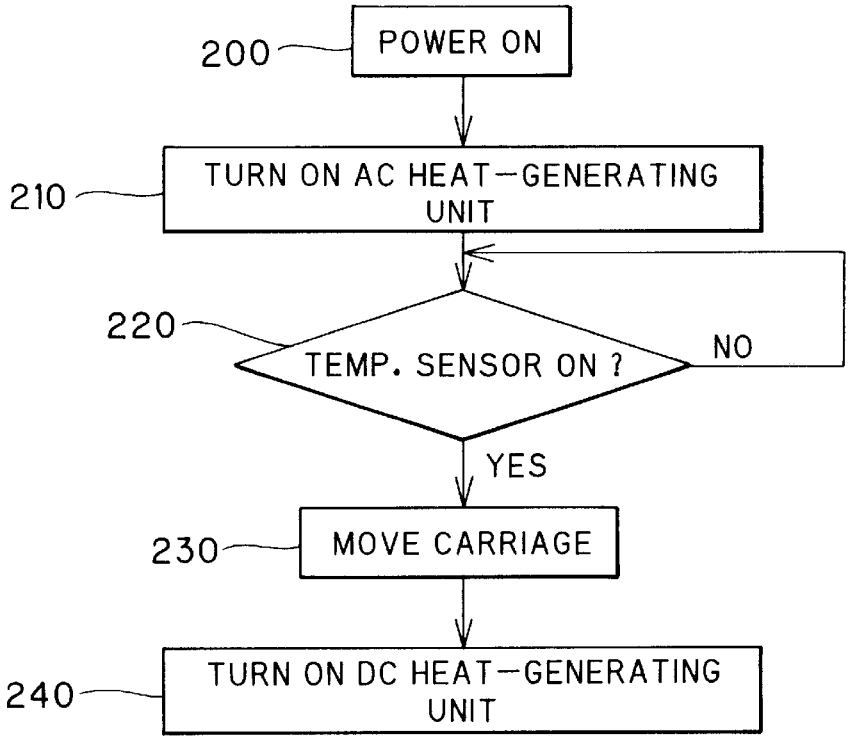
FIG. 15 is a flowchart illustrating a program for controlling the heater.

In the flowchart of FIG. 15, when the recording device 101 is powered (step 100), the carriage 112 is disposed in a home position and a 100V AC current is supplied to the AC heater section 176 to generate heat therein (step 110). The CPU 130 detects that the temperature sensor 132 is rendered ON (step 120). The temperature sensor 132 is rendered ON when the ink temperature reaches to a temperature suitable for printing, for example, 125° C. This can be typically achieved after expiration of about three minutes from the time when the recording device 101 is turned ON. Thereafter, a carriage movement signal is output to the CR drive circuit 137 to move the carriage 121 (step 130). When the carriage 121 leaves from the home position, the head 110 is disconnected from the AC socket 212. Therefore, the AC power supply to the AC heater section 176 from the AC power source 184 is stopped. Then, a power source switch signal for switching from the AC power source 184 to the DC power source 182 is output to the switch circuit 180 shown in FIG. 14, whereupon the DC power source 180 is connected to the heater 170 and the DC heater section 172 starts generating heat (step 140).

As described above, when the recording device 101 is powered ON, the ink in the ink tank 150 is solidified. In this condition, the AC current flows in the AC heater section 176 to generate heat. High thermal output from the AC heater section 176 can melt the solidified ink in a short period of time, for example, three minutes after the power of the recording device 101 is turned ON. The DC heater section 162 generates a low thermal output but it is sufficient for maintaining the ink in a molten state. In this manner, selective use of the AC heater section 176 and the DC heater section 162, a startup time of the recording device can be reduced significantly.

Because the ink volume reduces when it solidifies after the recording device is turned OFF, air remains in the ink chamber. When the recording device 101 is subsequently turned ON and printing is carried out, ink with air bubbles therein is ejected from the nozzles, resulting in degradation of printing quality. To cope with this problem, a maintenance operation described below is conducted to remove the air bubbles at the time of startup or at every predetermined interval.

A projection (not shown) for depressing the lever 158 is provided in the vicinity of the travel path of the recording head 110 inside the recording device 101. When the recording head 110 is moved to the position where the projection is provided, the lever 158 is depressed by the projection for a predetermined time duration as measured by the timer 149. The data of the time duration is stored in the ROM 134.

By depressing the lever 158, one end 162 of the valve 160 is raised up against the spring force of the leaf spring 157, thereby opening the first inlet opening 153. A hose is connected to the air supply opening 165 to feed air inside the primary chamber 151. As a result, the ink in the primary chamber 151 is pressurized, circulated through the head 111, and fed into the secondary chamber 152.

When the timer 149 becomes time-up, the driving of the pump is halted and the recording head 110 leaves from the position where the projection is provided. Then, the first inlet opening 153 closes, and the first outlet opening 154 opens. The ink in the secondary chamber 152 flows through the connecting channel 156 into the primary chamber 151 via the second inlet opening 155. When the primary chamber 151 is exposed to the air, the air bubbles disappears.

The ink flows out of the primary chamber 151 via the second outlet opening 165 and is introduced into the head 111, and the ink is ejected from the nozzles of the head 111. During printing, since the first inlet opening 153 is closed by the valve 160, the ink in the head 111 does not flow back into the secondary chamber 152.

When the recording device 101 is turned OFF after printing, the supply of DC current from DC power source 182 to heater 170 is halted. The temperature in the ink tank 150 falls, and the ink begins to solidify.

As described, ink circulation can be conducted by manipulating a single lever. This can simplify the structure inside the ink tank.

Figure 16:
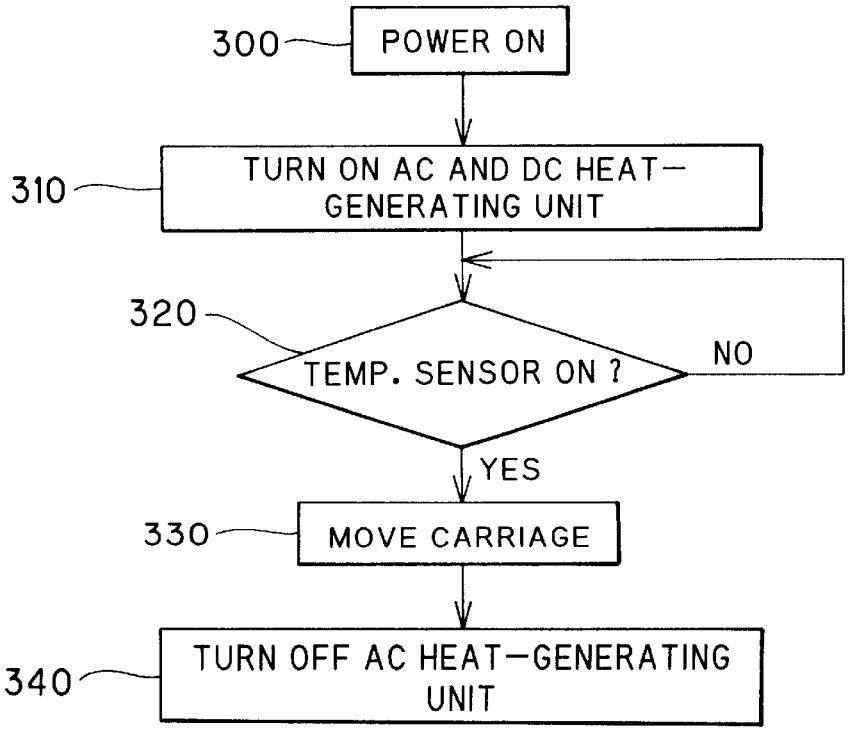
FIG. 16 is a flowchart showing a modification of the flowchart shown in FIG. 15.

As shown in the flowchart of FIG. 16, a modification of the flowchart shown in FIG. 15 can be made. Specifically, when the recording device 101 is powered (step 200), both the AC heater section 176 and the DC heater section 172 are energized simultaneously (step 210). When the ink temperature reaches the predetermined temperature (step 220), the carriage 121 is moved (step 230), and only the AC heater section 176 is deenergized (step 230).

According to above-described modification, since both the AC heater section 176 and DC heater section 172 generate heat, an even higher thermal output can be generated than when an AC heater section 176 alone is used as in the embodiment described above. Therefore, the melting time of the ink can be further shortened.

Other modification can be made wherein at least the AC heater section 176 is energized until the temperature sensor 132 detects a first temperature (for example, 110° C.) higher than the ink melting point. When temperature above the first temperature is detected, only the DC heater section 172 is energized. The DC heater section 172 is driven continuously until a second temperature suitable for printing operations (for example, 125° C.) is reached. After that, an amount of current supplied to the DC heater section 172 is controlled by a duty control or the like based on the data from the temperature sensor 132 so that the second temperature is maintained.

Also, a single heater section may be selectively energized by the AC and DC power sources 182 and 184. Changeover of the power source is implemented by a switch. As shown in FIG. 13(*a*), the heater 170 can also be provided in the ink flow path outside the ink tank 150. For example, the heater 170 may be provided inside the recording head 110. Further, by changing the amount of current supplied to the heat generating sections and the resistance values of the heat generating sections, electric consumption in each heat generating section, i.e., an amount of thermal output, can be adjusted. By doing so, the ink meting time can be adjusted while taking into account variation of melting temperature of the ink and the room temperature where the recording device is located.

The materials forming the various components of the heater 170 and the temperature sensor 132 are not limited to those described above.

What is claimed is:

1. An ink jet recording device comprising:

a recording head for ejecting ink droplets onto a recording medium to record images thereon, ink being in a solid state at a room temperature and being brought to a molten state when heated up to a predetermined temperature;

heating means for heating the ink, said heating means including an AC heater energized by an AC power and a DC heater energized by a DC power wherein said AC heater generates a first thermal output and said DC heater generates a second thermal output smaller than the first thermal output;

AC power supplying means for supplying the AC power to said AC heater when said AC power supplying means is enabled; and DC power supplying means for supplying the DC power to said DC heater when said DC power supplying means is enabled, wherein at least said AC power supplying means is enabled when said recording head is in a home position.

2. An ink jet recording device according to claim 1, wherein both said AC power supplying means and said DC power supplying means are enabled when melting the ink from the solid state to the molten state.

3. An ink jet recording device according to claim 2, wherein only said DC power supplying means is enabled when maintaining the ink in the molten state.

4. An ink jet recording device according to claim 1, wherein only said AC power supplying means is enabled when melting the ink from the solid state to the molten state.

5. An ink jet recording device according to claim 4, wherein only said DC power supplying means is enabled when maintaining the ink in the molten state.

6. An ink jet recording device according to claim 1, wherein said recording head is disposed in a home position at a time of powering, said recording head being movable in a main scanning direction when ejecting the ink droplets onto the recording medium, and wherein both said AC power supplying means and said DC power supplying means are enabled when said recording head is in the home position.

7. An ink jet recording device according to claim 6, wherein only said DC power supplying means is enabled when said recording head is in a position other than the home position.

8. An ink jet recording device according to claim 6, wherein said AC power supplying means comprises a socket provided in said recording head wherein said socket is moving with said recording head and is connected to said AC heater, and a plug provided in said frame and connected to an AC power source, said socket and said plug being engaged with each other to connect said AC power source to said AC heater when said recording head is in the home position.

9. An ink jet recording device according to claim 8, wherein said socket is disengaged from said plug so that said AC heater is disconnected from said AC power source when said recording head is in the position other than the home position.

10. An ink jet recording device according to claim 9, wherein said heating means comprises a plate-shaped base member made from an insulating material, said plate-shaped base member having a first surface to which said AC heater is attached and a second surface to which said DC heater is attached, a first electrode member formed on the first surface and connected to said AC heater, a second electrode member formed on the second surface and connected to said DC heater, a first lead wire having one end connected to said first electrode member and another end connected to said plug, and a second lead wire having one end connected to said second electrode member and another end connected to a DC power source.

11. An ink jet recording device according to claim 10, wherein said plug is connected to said AC power source by a reinforced wiring of a dual insulation structure.

12. An ink jet recording device according to claim 10, wherein said DC power source produces the DC power upon converting the AC power supplied from said AC power source.

13. An ink jet recording device according to claim 1, wherein said recording head comprises a head portion, a tank portion storing hot melt ink, and ink supplying means connecting said head portion and said tank portion wherein said head portion and said tank portion are in fluid communication with each other, wherein said heating means is provided in association with said head portion, said tank portion and said ink supplying means.

14. An ink jet recording device according to claim 1, further comprising temperature detecting means for detecting a temperature of the ink and outputting a temperature signal indicative of the temperature of the ink, and heat control means for controlling said AC power supplying means and said DC power supplying means in response to the temperature signal.

15. An ink jet recording device according to claim 14, wherein said heat control means enables said AC power supplying means when the temperature signal indicates that the temperature of the ink is less than a predetermined temperature, and disables said AC power supplying means and enables said DC power supplying means when the temperature signal indicates that the temperature of the ink has reached to the predetermined temperature.

16. An ink jet recording device according to claim 14, wherein said heat control means enables both said AC power supplying means and said DC power supplying means when the temperature signal indicates that the temperature of the ink is less than a predetermined temperature, and disables said AC power supplying means and enables only said DC power supplying means when the temperature signal indicates that the temperature of the ink has reached to the predetermined temperature.

17. An ink jet recording device according to claim 14, wherein said heat control means disables said AC power supplying means when the temperature signal indicates that the temperature of the ink is above a melting temperature but below an optimum temperature suitable for printing.

18. An ink jet recording device according to claim 17, wherein said heat control means controls said DC power supplying means so that the optimum temperature of the ink is maintained.

* * * * *